US008683797B1

(12) United States Patent
Jacoby

(10) Patent No.: US 8,683,797 B1
(45) Date of Patent: Apr. 1, 2014

(54) CLOSED CYCLE HEAT ENGINE WITH CONFINED WORKING FLUID

(76) Inventor: John Donald Jacoby, Ketchum, ID (US)

( * ) Notice: Subject to any disclaimer, the term of this patent is extended or adjusted under 35 U.S.C. 154(b) by 55 days.

(21) Appl. No.: 13/417,232

(22) Filed: Mar. 10, 2012

(51) Int. Cl.
*F02G 1/04* (2006.01)
*F01B 29/10* (2006.01)

(52) U.S. Cl.
USPC ..... 60/519; 60/508

(58) Field of Classification Search
USPC ..... 60/508, 519, 650, 682; 418/208–209, 418/228–229
See application file for complete search history.

(56) References Cited

U.S. PATENT DOCUMENTS

| | | | | |
|---|---|---|---|---|
| 3,169,375 | A | 2/1965 | Velthuis | |
| 3,677,329 | A * | 7/1972 | Kirkpatrick | 165/104.26 |
| 3,698,184 | A | 10/1972 | Barrett | |
| 3,867,815 | A | 2/1975 | Barrett | |
| 3,886,913 | A * | 6/1975 | Blanchard | 123/44 D |
| 4,089,174 | A | 5/1978 | Posnansky | |
| 4,357,800 | A | 11/1982 | Hecker | |
| 4,502,284 | A | 3/1985 | Chrisoghilos | |
| 4,621,497 | A | 11/1986 | McInnes | |
| 5,325,671 | A | 7/1994 | Boehling | |
| 5,571,244 | A * | 11/1996 | Andres | 123/231 |
| 2006/0283420 | A1* | 12/2006 | Mihailescu | 123/204 |
| 2009/0313989 | A1* | 12/2009 | Doss | 60/519 |

FOREIGN PATENT DOCUMENTS

| | | | |
|---|---|---|---|
| DE | 2410783 A | * | 9/1975 |
| DE | 19853946 A1 | * | 5/2000 |

OTHER PUBLICATIONS

Callen, Herbert B. Thermodynamics and an Introduction to Thermostatics. 2nd ed. John Wiley & Sons. (1985).*
Cengel, Yunus A. Heat Transfer: A Practical Approach. 2nd ed. Mcgraw-Hill. (2002).*

* cited by examiner

*Primary Examiner* — Thomas Denion
*Assistant Examiner* — Mickey France
(74) *Attorney, Agent, or Firm* — Jeffrey Parry Intellectual Property Law Group PLLC; Jeffrey C. Parry

(57) ABSTRACT

The current invention is a closed cycle heat engine that includes a plurality of variable volume movable working chambers, each chamber having a first volume of working fluid when disposed at an isentropic expansion zone leading edge, a second volume when disposed at an isentropic expansion zone trailing edge, a third volume when disposed at an isentropic compression zone leading edge and a fourth volume of working fluid when disposed at an isentropic compression zone trailing edge. The second volume of working fluid divided by the first volume of working fluid provides a first volume ratio. The third volume of working fluid divided by the fourth volume of working fluid provides a second volume ratio. The first volume ratio equals the second volume ratio. The working fluid efficiently performs work by traversing a cycle consisting of an isothermal expansion, an isentropic expansion, an isothermal compression, and an isentropic compression.

18 Claims, 5 Drawing Sheets

(a)

(b)

CLOSED CYCLE HEAT ENGINE WITH CONFINED WORKING FLUID

FIELD OF INVENTION

This invention relates to a closed cycle rotary heat engine with confined working fluid. More particularly, the invention relates to a closed cycle heat engine having a ratio of volumes of working chambers positioned when disposed at an isentropic expansion zone trailing edge and at an isentropic expansion zone leading edge set equal to a ratio of volumes of working chambers when disposed at an isentropic compression zone leading edge and at an isentropic compression zone trailing edge.

BACKGROUND OF INVENTION

Heat engines are well known for their ability to convert heat energy to usable work. Heat engines such as steam engines, steam and gas turbines, diesel engines, and Stirling engines can provide power for transportation, machinery, or producing electricity, to name a few.

Rotary heat engines have a rotating hub of dynamic chambers, containing a working fluid, that are coupled to work-transfer elements to deliver mechanical work-output. They operate in a cyclical manner. Heat is added to the confined working fluid during a portion of the cycle and heat is rejected from the working fluid during another portion of the cycle. Heat causes expansion of the working fluid as work is performed. A portion of the work is used to compress the working fluid as heat is rejected. The work performed by the working fluid during expansion minus the work used to compress the working fluid during compression is the net work available to overcome friction and deliver mechanical work-output.

Because heat engines cannot convert all the input energy to useful work, some of the heat is not available for mechanical work, where the percentage of thermal energy that is converted to mechanical work defines the thermal efficiency of the heat engine. The theoretical upper limit of efficiency of a heat engine cycle is that of the Carnot Cycle. Practical heat engines such as the Rankine, Brayton, or Stirling engines operate on less efficient cycles. Typically, the highest thermal efficiency is achieved when the input (heat zone) temperature is as high as possible and the output (cold zone) temperature is as low as possible.

The Carnot cycle has long been considered the ideal heat engine cycle. It has been the goal of many heat engine designers. However, to attain Carnot cycle efficiency would be meaningless, since no power would be developed. Attempts have been made to improve the efficiency of heat engines. But, maximum power of a heat engine occurs at efficiencies considerably below Carnot cycle efficiency. Carnot cycle efficiency is only a limit of efficiency, not necessarily an ideal goal. Of course, it is desirable to balance desired power, efficiency, and cost.

There are many, many heat engine designs. There are internal combustion engines, external combustion engines, piston engines, turbine engines, rotary engines and many others. The instant invention is a closed cycle rotary heat engine.

The following patents appear to have relevancy to the instant invention:

1. U.S. Pat. No. 3,169,375, Rotary Engines or Pumps, by Velthuis, Feb. 16, 1965
2. U.S. Pat. No. 3,698,184, Low Pollution Heat Engine, by Barrett, Oct. 17, 1972

3. U.S. Pat. No. 3,867,815, Heat Engine, by Barrett, Feb. 25, 1975
4. U.S. Pat. No. 4,089,174, Method and Apparatus for Converting Radiant Solar Energy into Mechanical Energy, by Posnansky, May 16, 1978
5. U.S. Pat. No. 4,357,800, Rotary Heat Engine, by Hecker, Nov. 9, 1982
6. U.S. Pat. No. 4,502,284, Method and Engine for the Obtainment of Quasi-isothermal Transformation in Gas Compression and Expansion, by Chrisoghilos, Mar. 5, 1985
7. U.S. Pat. No. 4,621,497, Heat Engine, by McInnes, Nov. 11, 1986
8. U.S. Pat. No. 5,325,671, Rotary Heat Engine, by Boehling, Jul. 5, 1994

Except for Patent 7, they describe attempts to increase efficiency and power by circulating the working fluid external from the working chambers for heating and cooling. This, however, dilutes ideal isothermal expansion and isothermal compression, during the heating and cooling stages. Patents 6 and 8 more nearly provide ideal expansion and compression, since they minimize the heating and cooling areas being open to more than one working chamber at a time.

However, a second loss of efficiency for all of the Patents 1 through 8 occurs because heat is conducted from the hot areas to the cold areas by paths other than through the working fluid. Such a path would be through the housing.

A third loss of efficiency for all of the Patents 1 through 8, is the lack of defined dimensional parameters to assure proper temperature, pressure, and volume relationships of the working fluid.

What is needed is a heat engine that optimizes heat engine power and/or efficiency by having proper parametric relationships of temperature, pressure, and volume, as well as minimizing loss of efficiency by preventing heat loss by maximizing the amount of heat transfer from the heating areas to the cooling areas through the working fluid, and minimizing heat transfer through other conduction paths.

SUMMARY OF THE INVENTION

The current invention overcomes the teachings of the prior art by providing a closed cycle heat engine that includes a plurality of variable volume movable working chambers, each having a first volume of working fluid when disposed at an isentropic expansion zone leading edge, a second volume of working fluid when disposed at an isentropic expansion zone trailing edge, a third volume of working fluid when disposed at an isentropic compression zone leading edge, and a fourth volume of working fluid when disposed at an isentropic compression zone trailing edge. The second working fluid volume divided by the first working fluid volume provides a first volume ratio. The third working fluid volume divided by the fourth working fluid volume provides a second volume ratio. The first volume ratio is equal to the second volume ratio. The working fluid efficiently performs work by traversing a cycle consisting of an isothermal expansion, an isentropic expansion, an isothermal compression, and an isentropic compression.

According to one embodiment of the invention, the closed cycle heat engine includes a housing, with end closures, having a cylindrical shape with an inner surface and an outer surface. The current embodiment further includes a thermal layer that abuts the inner surface of the housing and is concentric with it. The inner surface of the thermal layer has a cylindrical-quadrant heat input span having a first temperature, a cylindrical-quadrant isentropic expansion span, a cylindrical-quadrant heat output span having a second temperature, and a cylindrical-quadrant isentropic compression span, where the first temperature is larger than the second temperature and both the temperatures are predetermined. Further included is a plurality of variable volume movable working chambers held by the housing and interfacing the thermal layer. Additionally, included is a work delivery transmission, where the working chambers convey work to the transmission and the transmission delivers the work outside the housing. According to the current embodiment, a working fluid is confined within the working chambers, where the working fluid receives heat from the heat input span and rejects heat to the heat output span, and a temperature drop in the isentropic expansion span is equal to a temperature rise in the isentropic compression span, where the cylindrical-quadrant spans of the thermal layer are disposed such that the previously mentioned first volume ratio and second volume ratio are equal and ensures a temperature range of the working fluid is less than a temperature difference between the heat input temperature and the heat output temperature and a specified power and efficiency is attained. Temperature differentials are required for heat to flow during heat input and heat output.

In one aspect of the current invention, the working chambers are a wedge shape having working chamber walls that include an outer surface of a vane hub, the thermal layer, planar surfaces of rectangular vanes slidingly fitted in the vane hub, and end closures. Here, the vane hub is eccentric to the thermal layer.

In another aspect of the invention, the working chambers have a cylindrical shape with working chamber walls that include a cylinder wall, a front surface of a moveable cylindrical piston disposed in the cylinder chamber and the thermal surface, where the piston is pivotably connected to a first end of a piston rod and a second end of the piston rod is disposed to pivot about an axis of a bearing post, where the bearing post is positioned eccentric to the thermal surface.

According to a third aspect of the invention, the working chambers have a cylindrical shape with working chamber walls that include a cylinder wall, a front surface of a cylindrical piston and the thermal layer, where a first piston is rigidly connected to a first end of a piston rod and a second end of the piston rod is rigidly connected a second piston, and where the piston rod has a bearing slot at the center of the rod for receiving a bearing post, where the bearing post is eccentric to the thermal surface.

BRIEF DESCRIPTION OF THE DRAWINGS

The objectives and advantages of the present invention will be understood by reading the following detailed description in conjunction with the drawings, in which.

DRAWINGS

Reference Numerals

Figure 1:
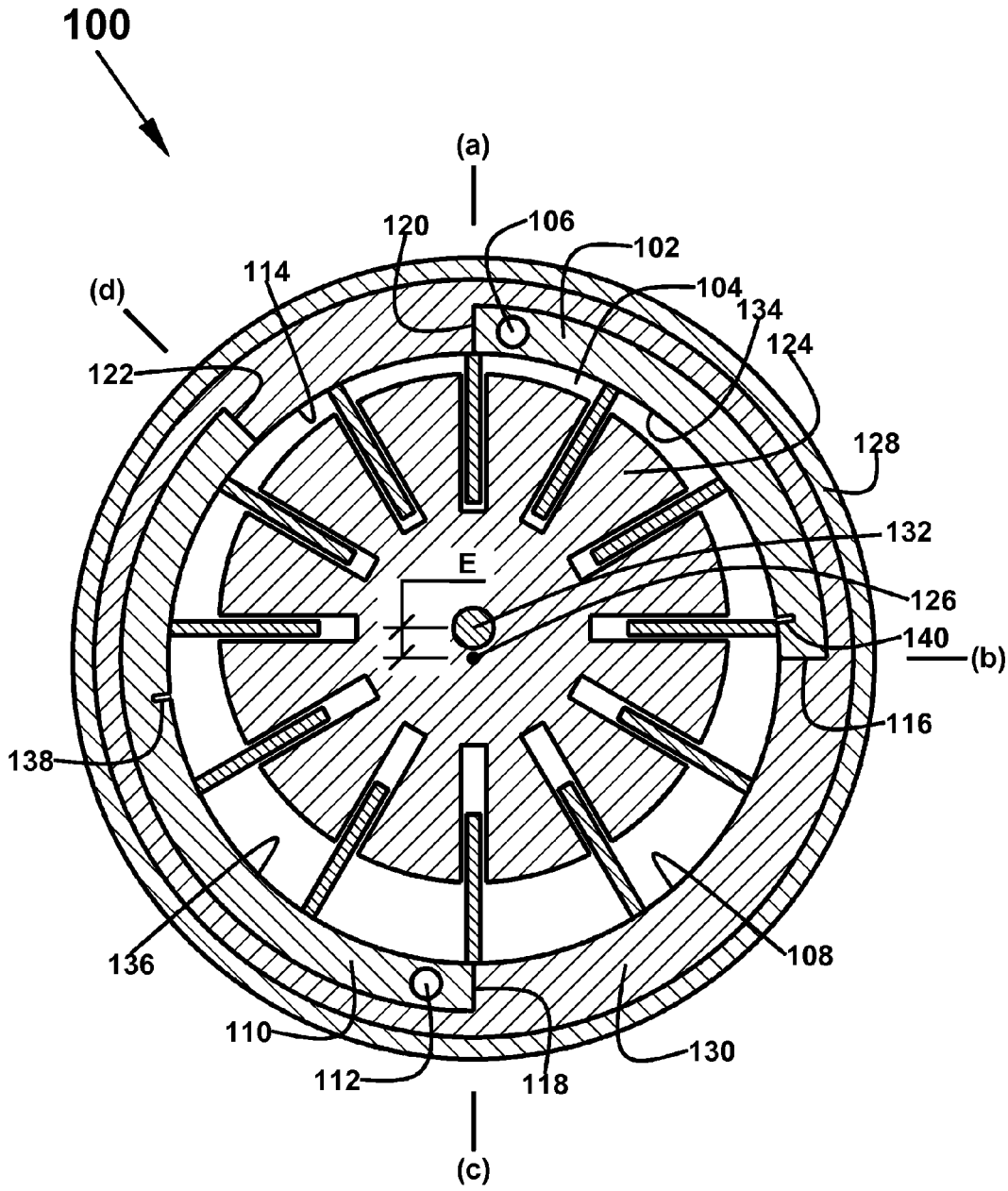
FIG. 1 shows a vane rotary heat engine according to the current invention.

100 vane rotary heat engine
102 hot element
104 working chamber
106 heat input port
108 cylindrical-quadrant isentropic expansion span (b to c)
110 cold element
112 cold input port
114 cylindrical-quadrant isentropic compression span (d to a)
116 isentropic expansion span leading edge (hot element 102 trailing edge)
118 isentropic expansion span trailing edge (cold element 110 leading edge)
120 isentropic compression span trailing edge (hot element 102 leading edge)
122 isentropic compression span leading edge (cold element 110 trailing edge)
124 rotating hub
126 central axis
128 cylindrical housing with end closures
130 thermally insulating liner
132 work delivery transmission
134 cylindrical-quadrant heat input span (a to b)
136 cylindrical-quadrant heat output span (c to d)
138 heat exchange cavity (in cold element 110)
140 heat exchange cavity (in hot element 102)
200 rotary heat engine cycle temperature—entropy diagrams
202 isothermal expansion process
204 isentropic expansion process
206 isothermal compression process
208 isentropic compression process
300 piston based working chamber
302 piston mechanism
304 pivotable independent connecting rods
306 eccentric post
308 piston chamber
310 rotating hub
312 work delivery transmission
320 connecting rods
322 centrally positioned slot
324 eccentric post
326 piston

DETAILED DESCRIPTION

Although the following detailed description contains many specifics for the purposes of illustration, anyone of ordinary skill in the art will readily appreciate that many variations and alterations to the following exemplary details are within the scope of the invention. Accordingly, the following preferred embodiment of the invention is set forth without any loss of generality to, and without imposing limitations upon, the claimed invention.

An efficient closed cycle rotary heat engine is described that uses a known constant-temperature heat input and a known constant-temperature heat output for providing work output. Referring to the figures, FIG. 1 shows an exemplary vane rotary heat engine 100 according to the current invention. The closed cycle rotary heat engine 100 has a thermal cycle that includes a cylindrical-quadrant heat input span 134, shown spanning from position (a) to position (b), where the working fluid in a working chamber 104 undergoes an isothermal expansion as heat is provided by a hot element 102 with a known constant temperature heat source (not shown) through at least one heat input port 106. Here it is understood that a plurality of heat input ports 106 to the hot element 102 is within the scope of the invention. Further shown is a cylindrical-quadrant isentropic expansion span 108 spanning from position (b) to position (c), where the working fluid in the working chamber 104 undergoes isentropic expansion without additional energy provided to the working fluid within the working chamber 104. Additionally, a cylindrical-quadrant heat output span 136 is shown spanning from position (c) to position (d), where heat is removed from the working fluid in the working chamber 104 by a cold element 110 with a known constant temperature cold source (not shown) via at least one cold input port 112. Here it is understood that a plurality of cold input ports 112 to the cold element 110 is within the scope of the invention. Further shown is a cylindrical-quadrant isentropic compression span 114 spanning from position (d) to position (a), where isentropic compression of the working fluid in the working chamber 104 continues without any additional energy removed. As described, FIG. 1 defines four processes: isothermal expansion, isentropic expansion, isothermal compression and isentropic compression. Working fluid is confined within variable volume movable working chambers 104 of the system for acting on a work delivery transmission 132. The working fluid receives heat from the hot element 102 and rejects heat to the cold element 110, and the temperature drop in the isentropic expansion is equal to the temperature rise in the isentropic compression.

In the current invention, efficiency is achieved by setting the absolute value of the ratio of the volume of the working chamber 104 when positioned at the isentropic expansion zone trailing edge 118 to the volume of the working chamber positioned at the isentropic expansion zone leading edge 116 equal to the absolute value of the ratio of the volume of the working chamber 104 positioned at the isentropic compression zone leading edge 122 to the volume of the working chamber positioned at the isentropic compression zone trailing edge 120. Providing a known constant hot element 102 temperature and a known constant cold element 110 temperature enables the arc-spans across the isentropic zones to be determined and the chamber volume ratios may be made equal for optimizing engine efficiency.

Some known constant heat input sources include geothermal, nuclear and fossil fuels, where some known constant cooling output sources include large bodies of water and radiators coupled to large heat sinks, to name a few.

Further shown in FIG. 1, the variable volume working chambers 104 are coupled to a rotating hub 124 affixed to a work delivery transmission 132, eccentric to a central axis 126 by a value (E). The working chambers 104 contain a confined, pressurized working fluid or gas such as helium, nitrogen, air or other gas having relatively high thermal conductivity.

In the closed-cycle system 100 of the current invention, the working fluid temperature is determined from the known values of the hot element 102 temperature and the cold element 110 temperature. Specifically, it is desirable to determine the working fluid temperature when the net heat is maximum, where the net heat of the system is the difference of the heat added $H_A=t_h(S_2-S_1)$ and the heat rejected $H_R=t_1(S_2-S_1)$ such that the net heat is $H_N=(t_h-t_1)(S_2-S_1)$. Here, $t_h$ is the working fluid high temperature, $t_1$ is the working fluid low temperature, $S_1$ is the entropy across the isentropic compression zone 114 beginning at the trailing edge 122 of the cold element 110 and ending at the leading edge 120 of the hot element 102, $S_2$ is the entropy across the isentropic expansion zone 108 beginning at the trailing edge 116 of the hot element 102 and ending at the leading edge 118 of the cold element 110.

From this, the system efficiency is equal to the ratio of the net heat divided by the heat added:

$$e = \frac{H_A - H_R}{H_A} = \frac{(t_h - t_l)(S_2 - S_1)}{t_h(S_2 - S_1)},$$

which simplifies to $$e = \frac{t_h - t_l}{t_h}.$$

The heat added and heat rejected can be expressed using thermodynamic principles that show the change in heat in a material is equal to the specific heat of the material multiplied by the mass, and the change in temperature e.g. $\Delta Q=c_t m\Delta T$. This can be expressed using the previously defined terms: $H_A=a(T_H-t_h)$ and $H_R=b(t_1-T_L)$. The coefficients (a) and (b) relate to the heat transfer between the working fluid and the hot element 102 and cold element 110 ($T_H$ and $T_L$, respectively) where the working fluid has a known mass and the hot element 102 and cold element 110 have specific heat transfer properties and surface areas.

The efficiency can now be expressed as $$e = \frac{a(T_H - t_h) - b(t_l - T_L)}{a(T_H - t_h)}.$$

The right side of that equation can be set equal to the right side of the previous equation $$e = \frac{t_h - t_l}{t_h}$$

so that the temperatures of the hot working fluid and cold working fluid can be expressed in terms of each other, that is $$t_h = \frac{at_l T_H}{(a+b)t_l - bT_L} \text{ and } t_l = \frac{bt_h T_L}{(a+b)t_h - aT_H},$$

respectively.

The net heat is expressed in a useful form, where $H_N=H_A-H_R=a(T_H-t_h)-b(t_1-T_L)$, and substituting for $t_1$ provides the expression $$H_N = aT_H - at_h - \frac{b^2 t_h T_L}{(a+b)t_h - aT_H} + bT_L.$$

To determine the maximum net heat, the derivative is set to zero, that is $$\frac{dH_N}{dt_h} = 0,$$

or $$\frac{dH_N}{dt_h} = a + \frac{((a+b)t_h - aT_H)(b^2T_L) - (b^2t_hT_L)(a+b)}{((a+b)t_h - aT_H)^2} =$$

$$\frac{a((a+b)t_h - aT_H)^2 + ((a+b)t_h - aT_H)(b^2T_L) - (b^2t_hT_L)(a+b)}{((a+b)t_h - aT_H)^2} = 0.$$

Expressing this as a quadratic equation:

$$t_h^2 - \left(\frac{2aT_H}{(a+b)}\right)t_h + \left(\frac{a^2T_H^2 - b^2T_HT_L}{(a+b)^2}\right) = 0.$$

Solving for the working fluid temperature $t_h$ when the net heat $H_N$ is maximum gives $$t_h = \frac{aT_H + b\sqrt{T_HT_L}}{a+b},$$

and $$t_h = \frac{aT_H - b\sqrt{T_HT_L}}{a+b}.$$

$t_h$ must be greater than the value where $t_h=t_1$. Previously, an equation was shown where $t_1$ was expressed in terms of $t_h$. So, substituting $t_h$ for $t_1$ in that equation gives:

$$t_h = \frac{bt_hT_L}{(a+b)t_h - aT_H}.$$

Solving the equation for $t_h$ results in:

$$t_h = \frac{aT_H + bT_L}{(a+b)},$$

the value where $t_h=t_1$. Since $t_h$ must be greater than $t_1$, the equation $$t_h = \frac{aT_H + b\sqrt{T_HT_L}}{a+b}$$

is the only root that qualifies. The equation for the maximum net heat is derived by substituting the right side of the equation for $t_h$ in the equation for the net heat, giving:

$$H_N^{Max} = \frac{abT_H - 2ab\sqrt{T_HT_L} + abT_L}{(a+b)}.$$

The relative work, $W_R$, is provided as $$W_R = \frac{H_N}{H_N^{Max}}$$

or $$W_R = \frac{aT_H - at_h - \frac{b^2t_hT_L}{(a+b)t_h - aT_H} + bT_L}{\frac{abT_H - 2ab\sqrt{T_HT_L} + abT_L}{(a+b)}}.$$

Solving for $t_h$ gives the following quadratic equation:

$$(a^2+2ab+b^2)t_h^2$$
$$-(2a^2T_H+abT_H+abT_L+2abT_H+b^2T_H+b^2T_L-abW_RT_H$$
$$+2abW_R\sqrt{T_HT_L}-abW_RT_L-b^2W_RT_H+2b^2W_R\sqrt{T_HT_L}-b^2W_RT_L)t_h$$
$$+(a^2T_H^2+abT_HT_L+abT_H^2+b^2T_HT_L-abW_RT_H^2+2abW_RT_H\sqrt{T_HT_L}-abW_RT_HT_L)=0$$

As previously determined, $$t_h = \frac{aT_H + b\sqrt{T_HT_L}}{a+b}$$

provides the temperature $t_h$ when the net heat $H_N$ is maximum, thus $$\frac{H_N}{H_N^{Max}} = 1.$$

Because $H_N$ is equivalent to the net work, $H_N^{Max}$ is equivalent to the maximum net work, $W_N^{Max}$, where the relative net work $W_R$ is also equal to one at that point.

The variables a, b, $T_H$, $T_L$ and $W_R$ must be known to determine $t_h$. Assuming that a, b, $T_H$ and $T_L$ are known, values for $W_R$ can be chosen from 0 to 1.

Referring again to the drawings, FIG. 1 shows the vane rotary heat engine 100 including a housing 128 of cylindrical shape with a concentric thermal layer abutting its inner surface. The thermal layer includes a thermally insulating liner 130 with an embedded hot element 102 and an embedded cold element 110. The inside surface of the thermal layer provides a cylindrical-quadrant heat input span 134, a cylindrical-quadrant isentropic expansion span 108, a cylindrical-quadrant heat output span 136, and a cylindrical quadrant isentropic compression span 114.

The outer surface of the thermally insulating liner abuts the inner surface of the housing 128. The inner surface of the thermally insulating liner 130 provides the cylindrical-quadrant isentropic expansion span 108 with an arc-length, set for a predetermined temperature drop of the working fluid, that spans from the isentropic expansion span leading edge 116 to the isentropic expansion span trailing edge 118. The thermally insulating layer 130 further provides the cylindrical-quadrant isentropic compression span 114 that extends concentrically with an arc-length, set for a predetermined temperature rise of the working fluid, spanning from the isentropic compression span leading edge 122 to the isentropic compression span trailing edge 120, where the absolute value of the temperature drop across the cylindrical-quadrant isentropic expansion span 108 is equal to the absolute value of the temperature rise across the cylindrical-quadrant isentropic compression span 114. The thermally insulating liner 130 is made from material having properties low in thermal conductivity, such as plastic, ceramic or glass and can be formed or machined to required mechanical tolerances. The insulating liner 130 isolates the hot element 102 and the cold element 110 from each other and from the cylindrical housing 128 confining the heat flow from the thermally conductive hot element 102 to the working fluid and from the working fluid to the thermally conductive cold element 110, providing higher efficiency. It is desirable that all parts of the heat engine, except for the hot element 102 and the cold element 110, have low thermal conductivity for maximum efficiency.

The thermally conductive hot element 102 is of cylindrical-quadrant shape and is positioned between the isentropic zones 108/114 having a hot element 102 leading edge 120 and a hot element 102 trailing edge 116 with at least one hot element 102 heat input port 106 extending there through. The outer surface of the hot element 102 abuts an inner surface of the thermally insulating liner 130 and an inner surface of the hot element 102 providing an isothermal cylindrical-quadrant heat input span 134 substantially flush with the cylindrical-quadrant isentropic spans 108/114. According to one embodiment, the hot element 102 can further have a plurality of heat exchange cavities 140 (only one is shown) extending radially into the inner surface of the hot element 102.

A thermally conductive cold element 110 has a cylindrical-quadrant shape positioned between the isentropic spans 108/114 having a cold element 110 leading edge 118 and a cold element 110 trailing edge 122 with at least one cold input port 112 extending there through. The outer surface of the cold element 110 abuts the inner surface of the thermally insulating liner 130 and the inner surface of the cold element 110 providing an isothermal compression span substantially flush with the isentropic spans 108/114. According to one embodiment, the cold element 110 further has a plurality of heat exchange cavities 138 (only one is shown) extending radially into the inner surface of the cold element 110.

The heat exchange cavities 138 and 140 enhance heat flow from the hot element 102 to the working fluid and from the working fluid to the cold element 110. As an example, if one half of the surface area is provided with holes having a depth equal to four times their diameter, the heat transfer area becomes approximately nine times as great, a considerable increase in that case. It should be noted that the heat exchange cavities 138 and 140 should not intersect the heat input ports 106 and the cold input ports 112, since the working fluid must remain confined. It is important that the heat exchange cavities 138 and 140 not be open to more than one working chamber 104 at a time.

Figure 2:
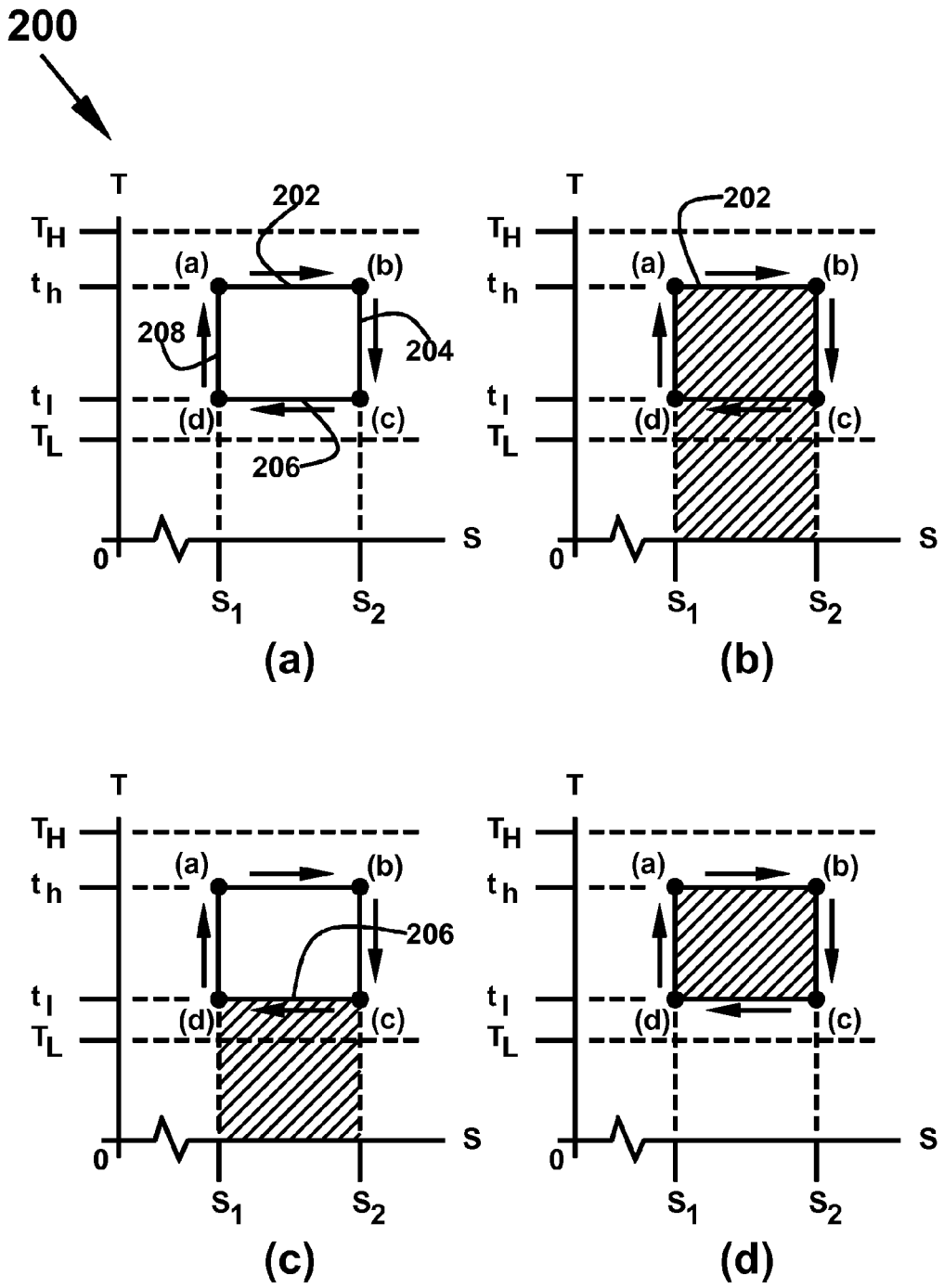
FIGS. 2*a*-2*d* show temperature-entropy diagrams of the rotary heat engine cycle according to the current invention.

FIG. 2(*a*) through FIG. 2(*d*) show rotary heat engine cycle diagrams 200 according to the current invention. Shown are rectangles of the four thermodynamic processes plotted on a temperature-entropy diagram, where the cycle progresses in the clockwise direction. The ordinate is temperature (T) and the abscissa is entropy (S), where the abscissa is shown in broken lines to illustrate that the absolute values of the entropy are unknown and only differences in entropy can be determined ($T_H$) is the temperature of the hot element 102, and ($T_L$) is the temperature of the cold element 110. As shown, the rotary heat engine cycle has the four processes: isothermal expansion 202 from point (a) to point (b), isentropic expansion 204 from point (b) to point (c), isothermal compression 206 from point (c) to point (d) and isentropic compression 208 from point (d) to point (a) to complete the cycle. In the isothermal expansion 202, work is performed on the working chamber 104 by the expanding working fluid as heat is added at temperature ($T_H$) to the working fluid. Here, the working fluid expands while maintaining constant high temperature ($t_h$). This expansion of the working fluid is converted into mechanical work as an eccentric rotating hub 124 (see FIG. 1), for example, rotates to turn a work delivery transmission 132 extending from inside to outside of the closed cycle heat engine.

During isentropic expansion 204, work is further performed on the working chamber 104 by the expanding working fluid as the hub 124 moves the working chamber 104 across the isentropic expansion zone 204 from point (b) to point (c). Here, work is exchanged for a temperature reduction in the working fluid to a low temperature ($t_1$) from point (b) to point (c).

In the isothermal compression 206 from point (c) to point (d), the working fluid is compressed and heat is removed to the cold element 110 at temperature ($T_L$) while maintaining the working fluid temperature ($t_1$).

In the isentropic compression 208, work is required in exchange for heating the working fluid to temperature ($t_h$) as the rotating hub 124 moves the working chamber 104 across the isentropic compression zone from point (d) to point (a) to complete the cycle.

The ratio of the change in chamber volumes across the isentropic zones 204/208 are made equal to ensure that the absolute value of the temperature drop from point (b) to point (c) is equal to the absolute value of the temperature rise from point (d) to point (a). The linear and angular dimensions, eccentricities and extents of the various components are adjusted to provide the required volume ratios that optimize the system.

The difference in the work performed and the work required is the net work available to overcome friction and to power external devices of the system. Further, the net work correlates to the difference between the heat added and the heat removed by the hot element 102 and cold element 110, respectively. In FIG. 2(*b*), the crosshatch area below the isothermal expansion 202 represents the heat added to the system. In FIG. 2(*c*), the crosshatch area below the isothermal compression 206 represents the heat removed from the system. In FIG. 2(*d*), the net heat is the difference between the heat added and the heat removed, represented by the area enclosed within the full-cycle rectangle.

The heat energy added ($H_A$) is the product of the working fluid high temperature ($t_h$) and the change in entropy from point (a) to point (b). Similarly, the heat energy removed ($H_R$) is the product of the working fluid low temperature ($t_1$) and the change in entropy from point (c) to point (d). The net heat energy ($H_N$) is the heat energy added less the heat energy rejected. The efficiency (e) of the current invention is the ratio of net heat energy ($H_N$) to the heat energy added to the system ($H_A$). The current invention provides an optimized rotary heat engine efficiency when the net heat energy ($H_N$) is a known value.

Figure 3:
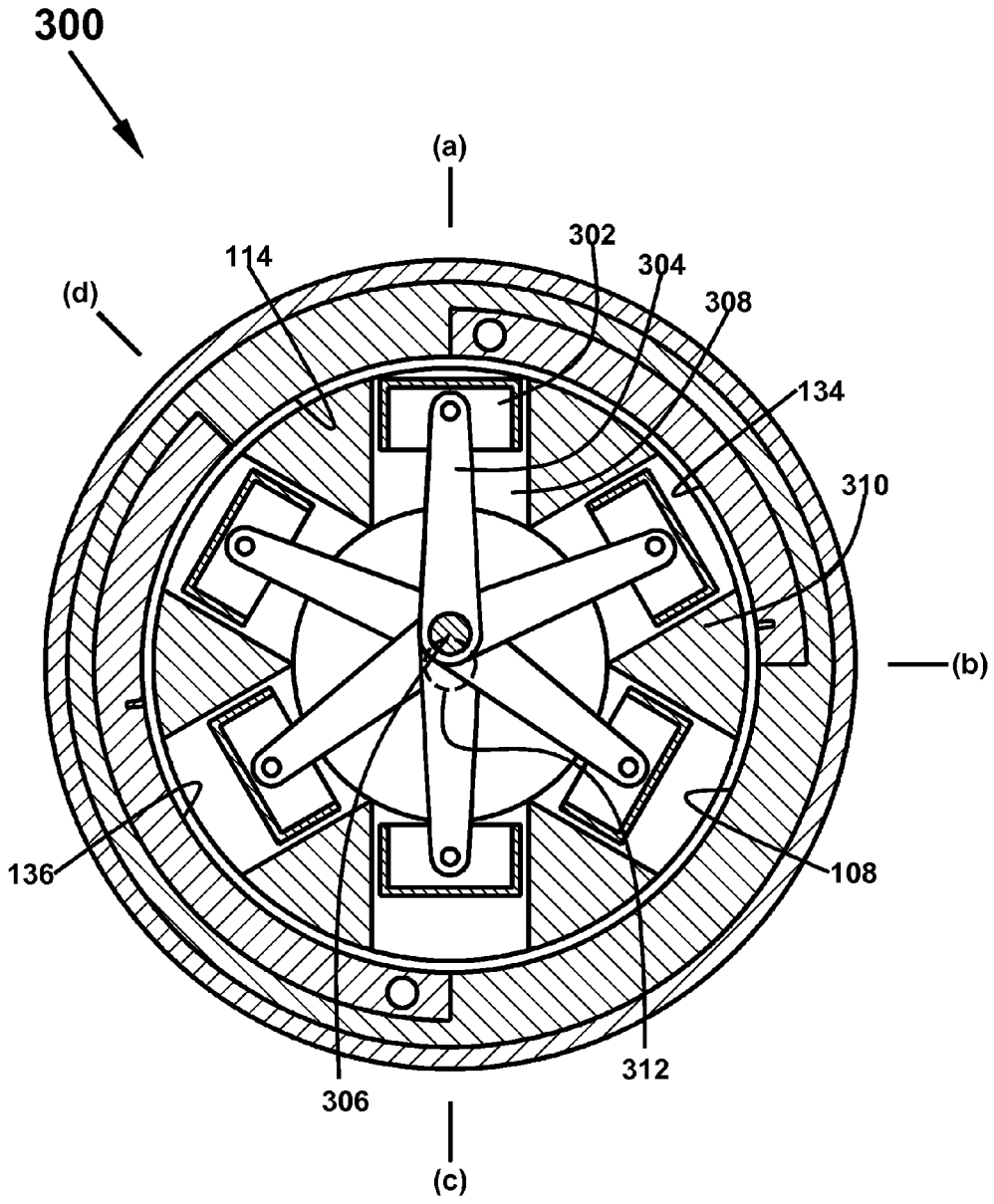
FIGS. 3*a*-3*b* show piston-based working chamber embodiments according to the current invention.
Figure 3:
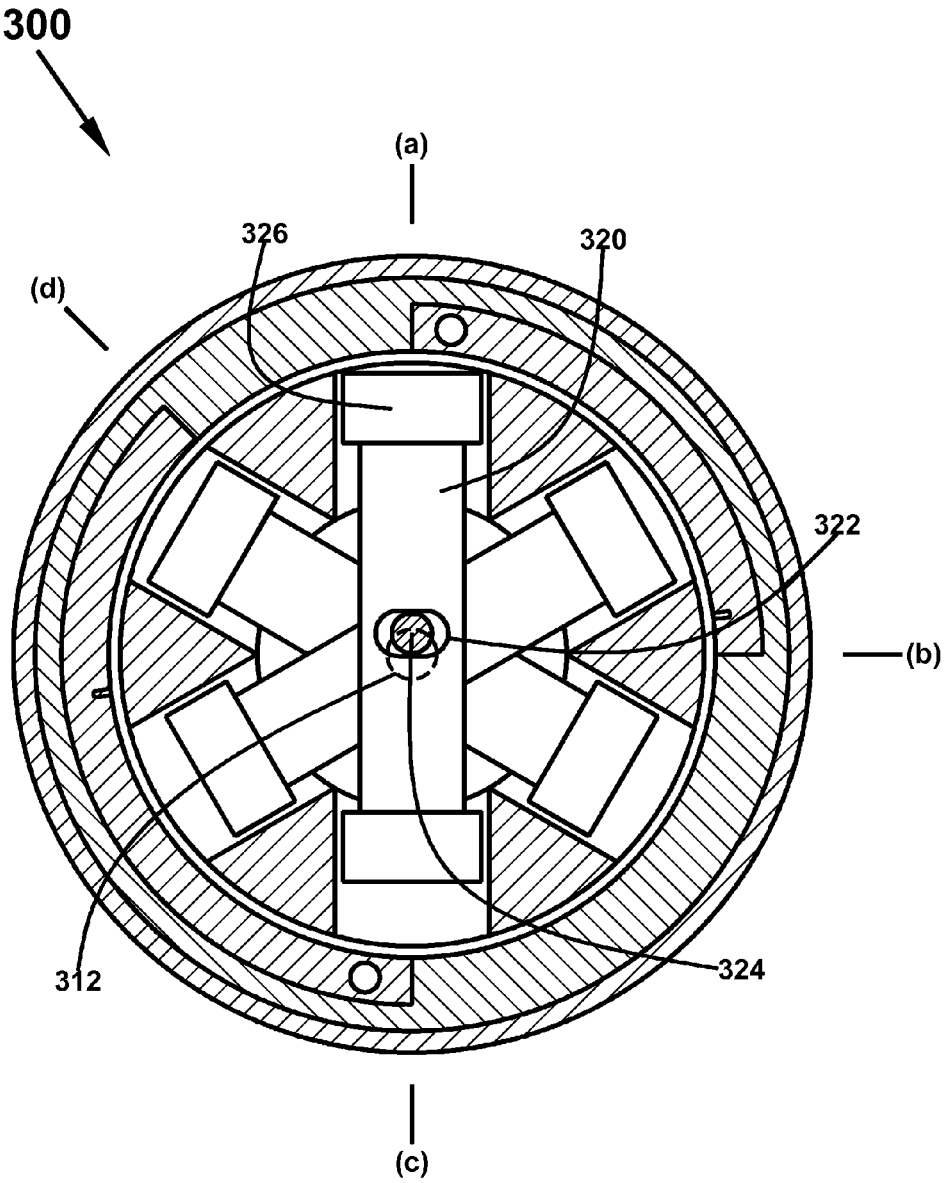

FIG. 3(*a*) and FIG. 3(*b*) show a piston-based working chamber 300 embodiment of the current invention. Shown in FIG. 3(*a*) are piston mechanisms 302 having pivotable independent connecting rods 304 that are contained within piston chambers 308 of the rotating hub 310, where the connecting rods 304 are pivotably connected to the piston 302. The connecting rods 304 are rotatably connected to an eccentric post 306 projecting from one end closure of the cylindrical housing 128 and eccentrically positioned relative to the center axis of the cylindrical-quadrant heat input span 134, the cylindrical-quadrant isentropic expansion span 108, the cylindrical-quadrant heat output span 136, and the cylindrical-quadrant isentropic compression span 114, as discussed above. The work delivery transmission 312, attached to the rotating hub, projects through the other end closure.

In another embodiment, FIG. 3(*b*) shows another piston-based working chamber 300, where the rods 320 are non-pivotable having a centrally positioned slot 322 where an eccentric post 324 is disposed in the slot 322. Opposing pistons 326 are connected at each end of the rod 320. As the heat is exchanged, the pistons 326 operate on the slots 322 of the rods 320 that move about the eccentric post 324 to provide work for output through the work delivery transmission 312.

Figure 4:
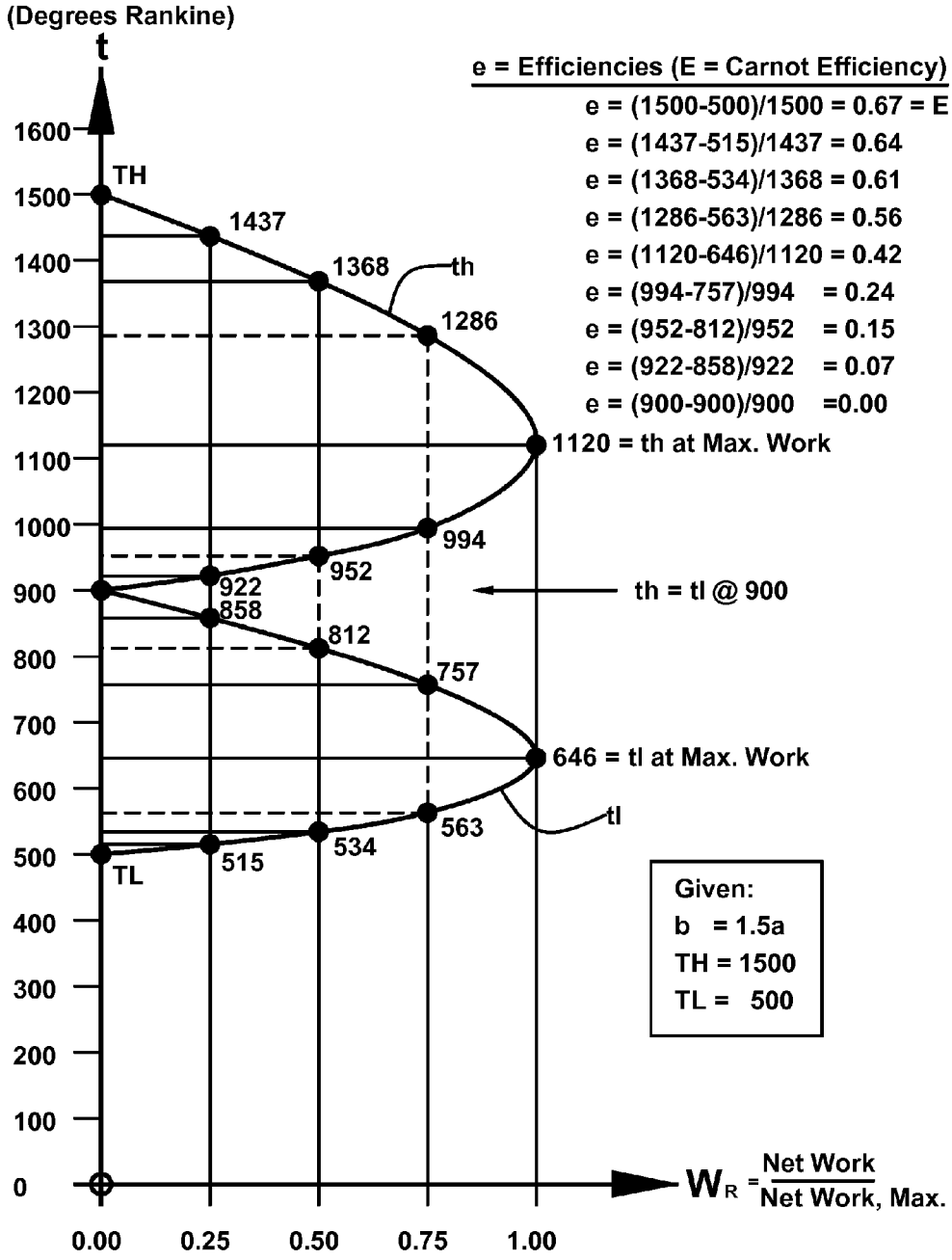
FIG. 4 shows a graph of temperature versus relative work.

FIG. 4 is a graph plotted using results from the included equations. The value of b is assumed to be 1.5 times the value of a. Values of $T_H$ and $T_L$ are assumed to be 1500 degrees Rankine and 500 degrees Rankine, respectively. Values of $t_h$ and $t_1$ are plotted to form the curves.

The graph shows the value of $t_h$ to be 1120 degrees Rankine and the value of $t_1$ to be 646 degrees Rankine when the net work is maximum. With those values, it is seen that the efficiency is equal to 42 percent.

Efficiency can be increased by increasing the value of $t_h$, with a corresponding decrease in the value of $t_1$. For example, when $t_h$ is assigned the value of 1437 degrees Rankine, the corresponding value of $t_1$ is 515 degrees Rankine. The efficiency with those values is seen to be 64 percent. However, the power will be less, since the work relative is seen to be 25 percent of the maximum.

It is seen that all values of $t_h$ must be less than $T_H$ in order for heat to flow, and all values of $t_1$ must be greater than $T_L$ in order for heat to flow. Of course, $t_1$ must be less than $t_h$. They become equal with the chosen parameters at a temperature of 900 degrees Rankine. At that point, of course, the efficiency is zero.

Efficiency is maximum when $t_h=T_H$ and $t_1=T_L$. However, although the efficiency equals the Carnot cycle efficiency of 67 percent, the Net Work is zero. Although it seems contradictory, it should be understood that the efficiency is a limit. No heat engine can operate at that efficiency with the chosen parameters. So it is with the Carnot cycle. No engine can operate with the efficiency defined by the Carnot cycle.

Other graphs similar to FIG. 4 can be developed by varying the parameters a, b, $T_H$, and $T_L$.

Assuming that it is desired to operate the engine at maximum power with the above parameters, th equals 1120 degrees Rankine and t1 equals 646 degrees Rankine. Using air as the working fluid and the thermodynamic equation $(t2/t1=(V1/V2)^{k-1})$, the volume ratio can be determined. For air, the specific heat ratio, k, equals 1.40. The equation can be rewritten as $(V1/V2=(t2/t1)^{1/(k-1)})$. Letting t2=1120 and t1=646, the volume ratio $(V_c/V_b)=(V_d/V_a)=(1120/646)^{2.5}=3.958$. The various dimensional parameters would need to be manipulated to give that volume ratio.

It should be noted that all parts, except the hot element 102 and the cold element 110, of the engine should, desirably, have low thermal conductivity so that maximum heat is transferred from the hot element 102 to the working fluid and from the working fluid to the cold element 110 in order to maximize the thermal efficiency. Also, power can be varied by increasing or decreasing the amount of working fluid within the engine, thereby increasing or decreasing the pressure and heat transfer to and from the working fluid. The means for increasing or decreasing the amount of the working fluid is not shown, since there are many ways of accomplishing that.

The present invention has now been described in accordance with several exemplary embodiments, which are intended to be illustrative in all aspects, rather than restrictive. Thus, the present invention is capable of many variations in detailed implementation, which may be derived from the description contained herein by a person of ordinary skill in the art. For example in reverse mode, by manipulating the various parameters, the invention is a refrigerator engine for removing heat from a body. Heat is absorbed by the working fluid from the cool zone and rejected to the heat zone.

All such variations are considered to be within the scope and spirit of the present invention as defined by the following claims and their legal equivalents.

What is claimed is:

1. A closed cycle heat engine comprising:

a cylindrical housing;

an inward facing thermally insulating liner within the housing;

an inward facing hot element surface within the housing having a hot span length;

an inward facing cold element surface within the housing having a cold span length;

wherein the insulating liner, the hot element surface, and the cold element surface together define an inward facing cylindrical surface;

a variable volume working chamber having a first wall of confinement, the first wall of confinement further comprising at least a portion of the inward facing cylindrical surface;

a working fluid confined within the working chamber;

wherein:

the hot element surface comprises a hot element surface temperature $T_H$;

the cold element surface comprises a cold element surface temperature $T_L$;

the working fluid comprises a high fluid temperature $t_h$ and a low fluid temperature $t_1$;

the working fluid comprises a specific heat ratio;

$t_h$ is lower than $T_H$;

$t_1$, is greater than $T_L$;

the insulating liner thermally insulates the hot element surface and the cold element surface from each other and from the housing;

the working chamber comprises a volume range that varies from a minimum volume $V_a$ to a maximum volume $V_c$;

the hot element surface comprises a hot surface leading edge located at a point defined by the minimum volume $V_a$;

the hot element surface comprises a hot surface trailing edge located at a point defined by a working chamber volume $V_b$;

the cold element surface comprises a cold surface leading edge located at a point defined by the maximum volume V;

the cold element surface comprises a cold surface trailing edge located at a point defined by a working chamber volume $V_d$;

the temperatures $t_h$ and $t_1$ are determined by resolving the equations:

$$(a+b)^2 t_h^2-[a+b][(2a+b)T_H+bT_L-bW_R(T_H+T_L-2(T_HT_L)^{1/2})]t_h+[a(a+b-bW_R)T_H^2+b(a+b-aW_R)T_HT_L+2abW_RT_H(T_HT_L)^{1/2}]=0$$

$$t_1=bt_hT_L/((a+b)t_h-aT_H)\quad e=(t_h-t_1)/t_h$$

$$V_b/V_c=(t_1/t_h)^{1/(1-k)}\quad V_a/V_d=(t_1/t_h)^{1/(1-k)};$$

wherein:

a has a value equal to one;

b has a value equal to a ratio of the cold span length to the hot span length;

e has a value equal to an efficiency of the closed-cycle heat engine;

$W_R$ has a value equal to relative work performed by the closed-cycle heat engine;

k has a value equal to the specific heat ratio;

parameters corresponding to $T_H$, $T_L$, b, $t_h$, $t_1$, $V_a$, $V_b$, $V_c$, $V_d$, e, $W_R$, and k can be manipulated to resolve the equations and to operate the closed-cycle heat engine at a desired combination of efficiency and relative work; and expansion and contraction of the working chamber and heat transfer between the hot element surface and the working fluid and between the cold element surface and the working fluid causes the working fluid to traverse a thermodynamic cycle comprising:

an isothermal expansion phase, the isothermal expansion phase occurring while the working fluid contacts and receives heat from the hot element surface and while the working fluid remains approximately at the high temperature $t_h$;

an isentropic expansion phase following the isothermal expansion phase, the isentropic expansion phase occurring while the working fluid contacts the thermally insulating liner and while the working fluid decreases in temperature to the low temperature $t_1$;

an isothermal compression phase following the isentropic expansion phase, the isothermal compression phase occurring while the working fluid contacts and rejects heat to the cold element surface and while the working fluid remains approximately at the low temperature $t_1$; and an isentropic compression phase following the isothermal compression phase, the isentropic compression phase occurring while the working fluid contacts the thermally insulating liner and while the working fluid increases in temperature to the high temperature $t_h$.

2. The closed cycle heat engine of claim 1, wherein the working fluid comprises a gas selected from the group consisting of helium, nitrogen, air, and combinations thereof.

3. The closed cycle heat engine of claim 1, further comprising a work delivery transmission, wherein the working chamber conveys work to the work delivery transmission and the work delivery transmission delivers work outside the housing.

4. The closed cycle heat engine of claim 1, wherein the working chamber comprises a wedge shape having working chamber walls comprising:

an outer surface of a vane hub eccentric to the inward facing cylindrical surface;

the inward facing cylindrical surface;

an end closure to the housing; and planar surfaces of a rectangular vane slidably fitted in the vane hub.

5. The closed cycle heat engine of claim 1, wherein the working chamber comprises a cylindrical shape having working chamber walls comprising:

a cylinder wall;

a front surface of a moveable cylindrical piston disposed in the working chamber; and the inward facing cylindrical surface;

wherein:

the piston is pivotally connected to a first end of a piston rod;

a second end of the piston rod is disposed to pivot about an axis of a bearing post; and the bearing post is positioned eccentric to the inward facing cylindrical surface.

6. The closed cycle heat engine of claim 1, wherein the working chamber comprises a cylindrical shape having working chamber walls comprising:

a cylinder wall;

a front surface of a moveable cylindrical piston disposed in the working chamber; and the inward facing cylindrical surface;

wherein:

the piston is rigidly connected to a first end of a piston rod;

a second end of the piston rod is rigidly connected to a second piston;

the piston rod has a bearing slot at the center of the rod for receiving a bearing post; and the bearing post is positioned eccentric to the inward facing cylindrical surface.

7. The closed cycle heat engine of claim 1, wherein:

the cold element surface comprises thermal conductivity to a cold input port and the hot element surface comprises thermal conductivity to a heat input port.

8. The closed cycle heat engine of claim 1, wherein the cold element surface comprises a heat transfer cavity.

9. The closed cycle heat engine of claim 1, wherein the hot element surface comprises a heat transfer cavity.

10. A method of performing work with a closed cycle heat engine, comprising:

isothermally expanding a working fluid confined within a working chamber of the closed cycle heat engine while the working fluid remains approximately at a high working fluid temperature $t_h$, wherein isothermally expanding the working fluid occurs while the working fluid contacts and receives heat from a hot element surface;

following isothermally expanding the working fluid, isentropically expanding the working fluid, wherein isentropically expanding the working fluid occurs while the working fluid contacts a thermally insulating liner and decreases in temperature to a low working fluid temperature $t_1$;

following isentropically expanding the working fluid, isothermally compressing the working fluid while the working fluid remains approximately at the low temperature $t_1$, wherein isothermally compressing the working fluid occurs while the working fluid contacts and rejects heat to a cold element surface; and following isothermally compressing the working fluid, isentropically compressing the working fluid, wherein isentropically compressing the working fluid occurs while the working fluid contacts the thermally insulating liner and while the working fluid increases in temperature to the high temperature $t_h$; and delivering work;

wherein:

the insulating liner, the hot element surface, and the cold element surface together define an inward facing cylindrical surface of the closed cycle heat engine;

the working chamber comprises a variable volume chamber having a first wall of confinement, the first wall of confinement further comprising at least a portion of the inward facing cylindrical surface;

the hot element surface comprises a hot element surface temperature $T_H$;

the cold element surface comprises a cold element surface temperature $T_L$;

the working fluid comprises a specific heat ratio;

$t_h$ is lower than $T_H$;

$t_1$, is greater than $T_L$;

the insulating liner thermally insulates the hot element surface and the cold element surface from each other;

the working chamber comprises a volume range that varies from a minimum volume $V_a$ to a maximum volume $V_c$;

the hot element surface comprises a hot surface leading edge located at a point defined by the minimum volume $V_a$;

the hot element surface comprises a hot surface trailing edge located at a point defined by a working chamber volume $V_b$;

the cold element surface comprises a cold surface leading edge located at a point defined by the maximum volume $V_c$;

the cold element surface comprises a cold surface trailing edge located at a point defined by a working chamber volume $V_d$;

the temperatures $t_h$ and $t_1$ are determined by resolving the equations:

$$(a+b)^2t_h^2-[a+b][(2a+b)T_H+bT_L-bW_R(T_H+T_L-2(T_HT_L)^{1/2})]t_h+[a(a+b-bW_R)T_H^2+b(a+b-aW_R)T_HT_L+2abW_RT_H(T_HT_L)^{1/2}]=0$$

$$t_1=bt_hT_L/((a+b)t_h-aT_H)\quad e=(t_h-t_1)/t_h$$

$$V_b/V_c=(t_1/t_h)^{1/(1-k)}\quad V_a/V_d=(t_1/t_h)^{1/(1-k)};$$

wherein:

a has a value equal to one;

b has a value equal to a ratio of the cold span length to the hot span length;

e has a value equal to an efficiency of the closed-cycle heat engine;

$W_R$ has a value equal to relative work performed by the closed-cycle heat engine;

k has a value equal to the specific heat ratio;

parameters corresponding to $T_H$, $T_L$, b, $t_h$, $t_1$, $V_a$, $V_b$, $V_c$, $V_d$, e, $W_R$, and k can be manipulated to resolve the equations and to operate the closed-cycle heat engine at a desired combination of efficiency and relative work.

11. The method of claim 10, wherein the working fluid comprises a gas selected from the group consisting of helium, nitrogen, air, and combinations thereof.

12. The method of claim 10, wherein delivering work comprises:

conveying work from the working chamber to a work delivery transmission of the closed cycle heat engine and delivering work from the work delivery transmission to outside a housing of the closed cycle heat engine.

13. The method of claim 10, wherein the working chamber comprises a wedge shape having working chamber walls comprising:

an outer surface of a vane hub eccentric to the inward facing cylindrical surface;

the inward facing cylindrical surface;

an end closure of a housing of the closed cycle heat engine; and planar surfaces of a rectangular vane slidably fitted in the vane hub.

14. The method of claim 10, wherein the working chamber comprises a cylindrical shape having working chamber walls comprising:

a cylinder wall;

a front surface of a moveable cylindrical piston disposed in the working chamber; and the inward facing cylindrical surface;

wherein:

the piston is pivotally connected to a first end of a piston rod;

a second end of the piston rod is disposed to pivot about an axis of a bearing post; and the bearing post is positioned eccentric to the inward facing cylindrical surface.

15. The method of claim 10, wherein the working chamber comprises a cylindrical shape having working chamber walls comprising:

a cylinder wall;

a front surface of a moveable cylindrical piston disposed in the working chamber; and the inward facing cylindrical surface;

wherein:

the piston is rigidly connected to a first end of a piston rod;

a second end of the piston rod is rigidly connected to a second piston;

the piston rod has a bearing slot at the center of the rod for receiving a bearing post; and the bearing post is positioned eccentric to the inward facing cylindrical surface.

16. The method of claim 10, wherein:

the cold element surface comprises thermal conductivity to a cold input port and the hot element surface comprises thermal conductivity to a heat input port.

17. The method of claim 10, wherein the cold element surface comprises a heat transfer cavity.

18. The method of claim 10, wherein the hot element surface comprises a heat transfer cavity.

* * * * *